US006011229A

United States Patent [19]

Geisler et al.

[11] Patent Number: 6,011,229

[45] Date of Patent: Jan. 4, 2000

[54] ELECTROSTATIC SEPARATOR FOR CLASSIFYING TRIBOELECTRICALLY CHARGED SUBSTANCE MIXTURES

[75] Inventors: Iring Geisler, Bad Hersfeld; Hans-Jürgen Knauer, Kassel; Ingo Stahl, Vellmar, all of Germany

[73] Assignee: Kali Und Salz GmbH, Kassel, Germany

[21] Appl. No.: 08/976,357

[22] Filed: Nov. 21, 1997

[30] Foreign Application Priority Data

Nov. 22, 1996 [DE] Germany ..... 196 48 373

[51] Int. Cl.[7] ..... B03C 7/00

[52] U.S. Cl. ..... 209/127.4; 209/128

[58] Field of Search ..... 209/127.1, 127.4, 209/128, 129, 130

[56] References Cited

U.S. PATENT DOCUMENTS

| | | | |
|---|---|---|---|
| 5,251,762 | 10/1993 | Taylor et al. | 209/127.4 |
| 5,542,543 | 8/1996 | Yasukuni | 209/127.1 |
| 5,687,852 | 11/1997 | Raschka et al. | 209/127.4 |

FOREIGN PATENT DOCUMENTS

| | | | |
|---|---|---|---|
| 1174274 | 7/1964 | Germany | 209/127.4 |
| 2609048 | 9/1977 | Germany . | |
| 4438704 | 4/1996 | Germany . | |
| 1776440 | 11/1992 | U.S.S.R. | 209/127.4 |

OTHER PUBLICATIONS

"Aufbereitung fester mineralischer Rohstoffe" (Treatment of Solid Raw Mineral Materials), vol. II, pp. 233–234, Leipzig, 1967.

*Primary Examiner*—Tuan N. Nguyen
*Attorney, Agent, or Firm*—Collard & Roe, P.C.

[57] ABSTRACT

An electrostatic separator of the free-fall type for classifying triboelectrically charged substance mixtures. This separator has a separate voltage source connected to each of the electrodes forming a pair of electrodes in such a way that the one voltage source supplies a positive voltage against ground potential and the other voltage source supplies a negative voltage against ground potential. This causes the potential difference against ground to be equal to zero in the center of the separator.

5 Claims, 4 Drawing Sheets

ELECTROSTATIC SEPARATOR FOR CLASSIFYING TRIBOELECTRICALLY CHARGED SUBSTANCE MIXTURES

BACKGROUND OF THE INVENTION

1. Field of the Invention

The present invention relates to an electrostatic free-fall separator for separating mixtures of substances, for example for separating mixtures of mineral raw materials, or also for the separation of plastic mixtures.

2. The Prior Art

According to the prior art, different types of free-fall separators are known, and all are operating based on the same principle. The particles to be separated are selectively oppositely electrically charged according to the triboelectric process and are permitted to free fall through a separation zone. This separation zone is defined by a pair of electrodes, and these electrodes have opposite electrical polarities brought about by applying a D.C. voltage to this pair of electrodes.

In this process, the electrodes can be designed in the form of plates, or revolving belts, or also in the form of a series of stationary or rotatably supported tubes. Due to the deflection of the particles in the electric field caused in accordance with the charge that they carry, three products are obtained. Hence, the products produced include a negatively charged material, a positively charged material, and an intermediate material. The quality of the products can be controlled by separating panels mounted at the end of the free fall drop line.

A separator operating according to the known prior art is described in Schubert, "*Aufbereitung fester mineralischer Rohstoffe*" (Treatment of solid raw mineral materials), Volume II, pp. 233–234, Leipzig, 1967, It is known according to DE 2,609,048, to use as electrodes revolving belts made of conductive material. A tube-type free-fall separator for separating plastic mixtures represents the state of the prior art according to DE 4,438,704. For the purpose of enhancing the purity of the separated products, provision is made according to this reference to arrange the tubes, which are known per se, in a staggered manner. Thus, these tubes are arranged with a gap in the distance relative to each other. The selectivity of the separation can be improved in this way.

In electrostatic separation, one single separator normally does not suffice for selectively separating two components to achieve a satisfactory purity. Hence, it is necessary to conduct a post separation of the products again in a two-stage or multi-stage installation. Disadvantages include having long distances of conveyance that have to be provided between the stages; the space requirement is substantial; and the investment costs rise with the increase in the number of stages. One further drawback of such multi-stage installations, which, as a rule, may comprise two and, in special cases, also three or more separators, is that horizontal conveyors are required. Thus, screw conveyors or chain conveyors are required in order to be able to convey intermediate fractions reciprocally from one separator to the other.

Two such horizontal conveyors are required in an installation with two separators. The horizontal conveyors, furthermore, substantially increase the quantity of circulating material. On the one hand, the residence time of the material in the installation increases, which may lead to increased electrical discharge of the charged particles. Electrical discharge may be caused not only by charge exchange between the electrically charged particles, but also by contact of the particles with the wall materials of the conveyor gear housing. On the other hand, the other drawback of an increased quantity of circulating material is that the achieving of the steady state equilibrium is delayed for the overall separation process.

SUMMARY OF THE INVENTION

It is therefore an object of the present invention to further improve a free-fall separator for electrostatic separation of mixtures of substances. In this manner, the space requirement is reduced while maintaining the same separation capacity or a higher separation capacity, and that a stable steady state operation equilibrium is reached more rapidly.

Now according to the invention, the above object is achieved in that the electrodes are in a separating space and they receive their electric potential via two separate voltage sources having different polarities. The one voltage source supplies a positive voltage against grounded potential, and the other supplies a negative voltage against grounded potential, which, in the center of the separator, causes the separation space to have a potential difference against ground to be equal to zero.

More particularly, the present invention is directed to electrostatic separator having a center for separating a triboelectrically charged mixture of substances, comprising a pair of electrodes with each electrode having an opposite polarity vertically arranged in a housing, with a separating space being formed between said electrodes; an inlet chute for the separating space through which the mixture to be separated is freely dropping into the separating space; a separate voltage source being connected to each of said electrodes in such a way that one voltage source supplies a positive voltage against ground potential and an other voltage source supplies a negative voltage against ground potential, causing a potential difference against ground to be equal to zero in the center of the separator, and said separating space containing said potential difference and causing separation products to be formed; and material outlet means for discharging said separation products.

Thus, a significant advantage of this arrangement is that with predetermined field intensity in the separating space and with the given dimensions, the field intensity between the electrodes and the housing drops to half the value. For example, the value of 2 kV/cm, which is the maximally permissible value according to the DIN-standard, will drop to only 1 kV/cm. Therefore, separation of the voltage according to the invention permits reducing to one-half the safety spacings required between the electrodes within the housing while maintaining the same separation capacity. In this way alone, the structural volume of one single separator, for example for a through-put of 1 ton/h, can be reduced from 8.6 $m^3$ to 3.8 $m^3$.

In another embodiment, instead of reducing the required safety spacing within the housing, it is also possible to increase the field intensity in the separation space without having to increase at the same time the required safety spacing within the housing. Because the particles can be deflected in the electric field in a superior way due to the higher electric field intensity, the height of the free-fall drop can be reduced, and the structural height of the housing can be consequently reduced.

In a further embodiment, a coarser granulate can be separated in a separator of given dimensions. This is because with a given surface charge density and a spherical particle with radius "r", the particle deflection in the electrical field with constant field intensity is inversely proportional to the radius of the particle. For example, when the particle radius is doubled, the particle deflection is reduced by half. This, in turn, can be compensated for by doubling the field intensity, to the extent permitted by the dielectric strength of the separator. Therefore, with given dimensions of a separator, division of the voltage permits separation of coarser granulate. This is of interest mainly when plastic granulate is separated within the requirements for the recycling of plastics.

According to a preferred embodiment of the invention, the volume of a separator installation for a plant with two separation stages can be additionally reduced. This is accomplished by arranging two separation devices in series in such a way that the pairs of electrodes, which each form a separation space or zone, are disposed closely adjacent to each other. The two pairs of electrodes are separated from each other only by a nonconductive electric insulator wall. In such an arrangement, electrodes having the same polarity are in each case arranged in an aligned fashion on the same side of the housing wall. Each of the separation spaces or zones is equipped with a separation space inlet. At the bottom end of the free-fall drop line are the material discharge means for intermediate material, positively charged material and negatively charged material. A total of at least two product outlets are present in this structure. Each of the other material outlets can be selectively connected with one of the two separation space inlets via a conveyor means depending on the separation task and the quality required for the separated products. Conveyance is usefully realized pneumatically via a conveying blower, or via an elevator.

According to the above structure, it is possible, for example by having a through-put rate of 1 ton/h and by using two separation stages, to reduce the volume of the separator installation from about 22 $m^3$ to 10 $m^3$.

If, when building an installation with two separators for separating a granulate with a given grain size, both features of the invention are combined, the volume of a separator installation with a 1 ton/h through-put rate can be reduced from about 22 $m^3$ to about 6 $m^3$, which corresponds with nearly only one-fourth of the volume of the installation according to the prior art. Another advantage of the invention is that two horizontal conveyor systems are no longer required to be used.

DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
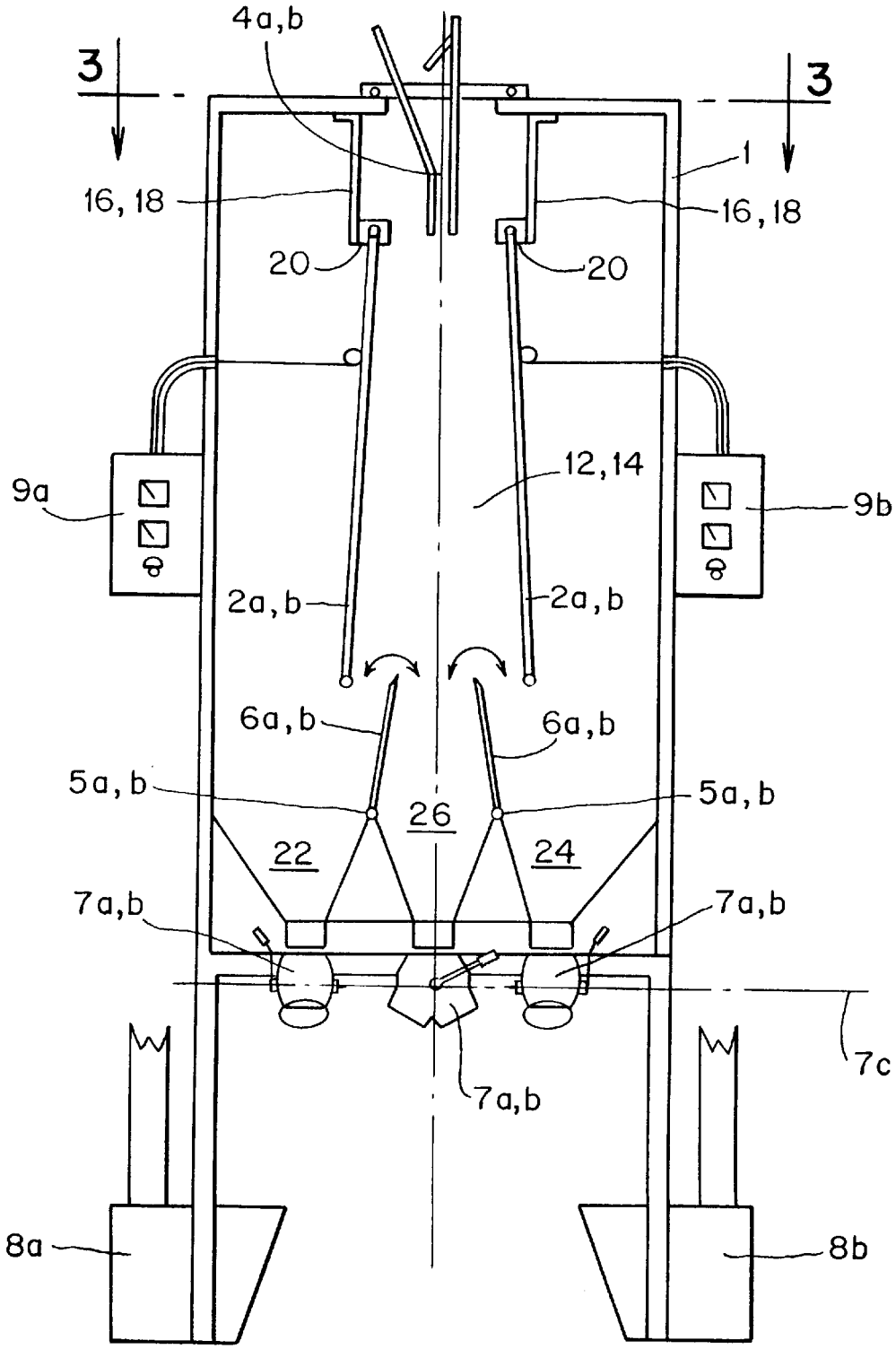
FIG. 1 shows a front view of a separator device with two separation stages according to the invention.
Figure 2:
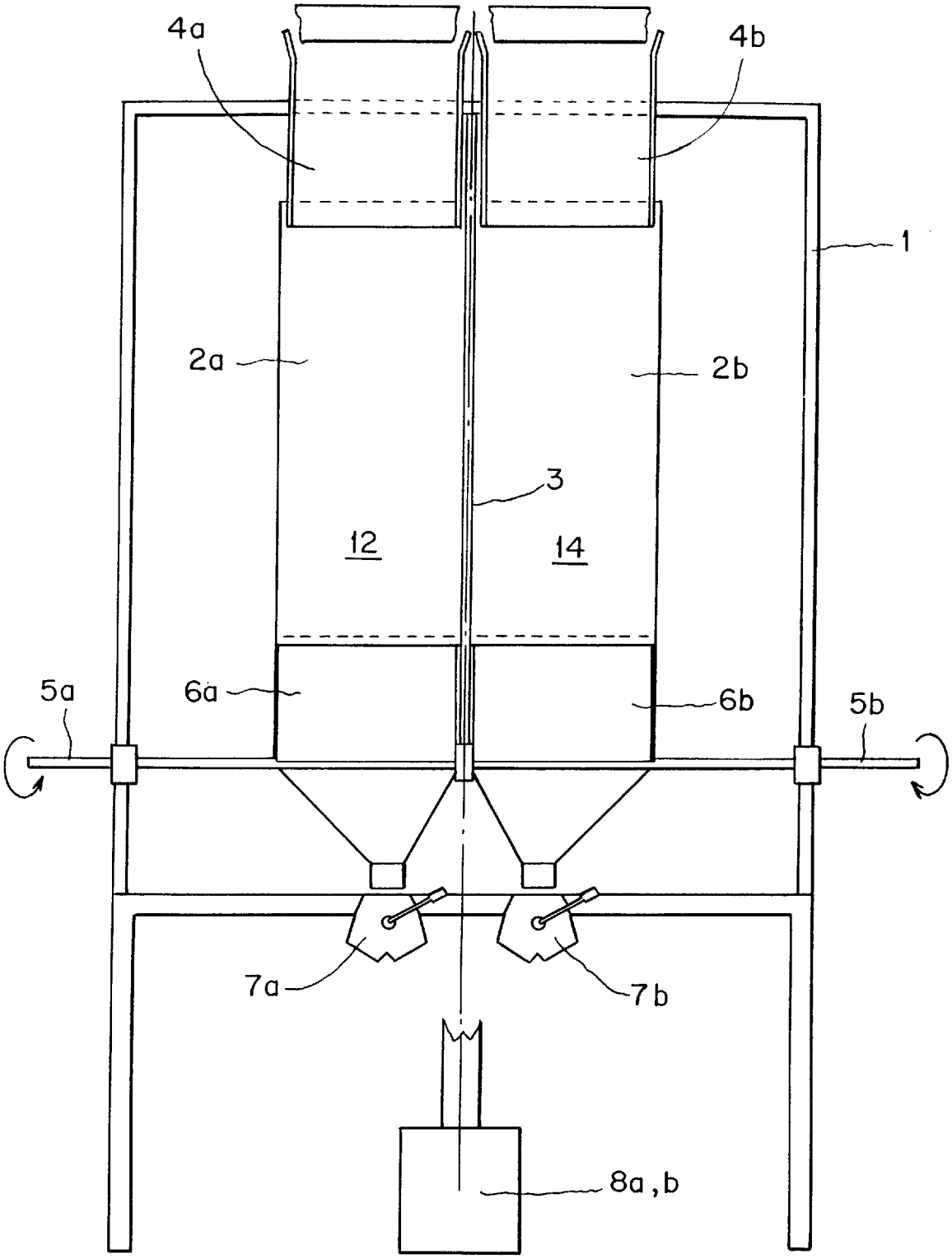
FIG. 2 shows a side view of the separator device of FIG. 1.
Figure 3:
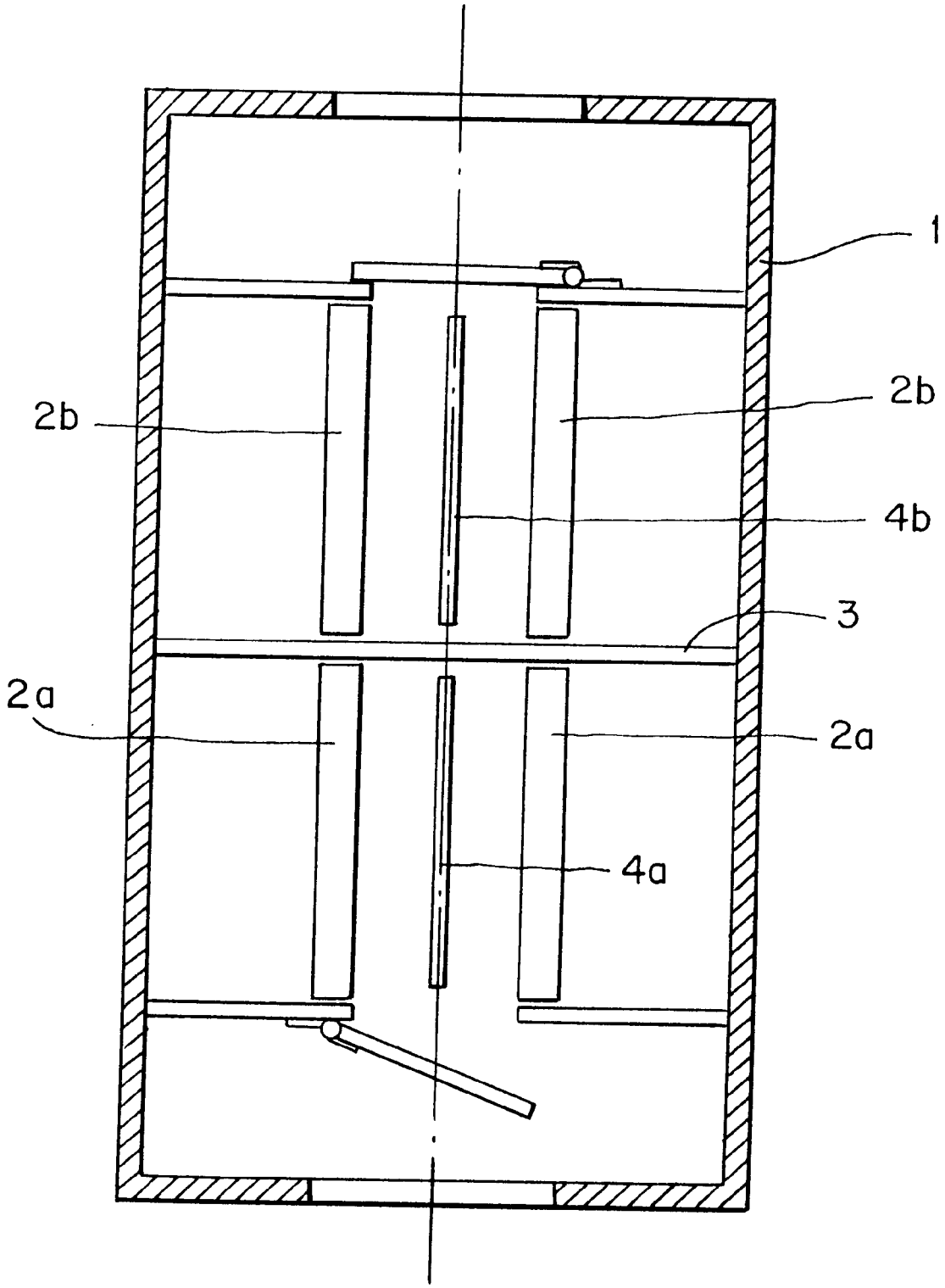
FIG. 3 shows a cross sectional view along line 3—3 at the level of the electrodes of FIG. 1.

Turning now in detail to the drawings, FIGS. 1 and 2 show in housing 1, for example four rows of parallel tube electrodes. Two opposite rows form two electrode pairs 2*a* and 2*b*. The said electrodes also can be selected from the group consisting of plate electrodes, static tube electrodes, rotating tube electrodes, and revolving belts. These electrodes are vertically arranged in such a way that the electrodes having the same polarity are aligned on the same side of the housing. The pairs of electrodes 2*a*, 2*b* are separated from each other by an electrical insulator wall 3 and are disposed closely adjacent to one another as shown in FIG. 3. Two separation zones 12 and 14 are created, which are defined by insulator wall 3 and the oppositely positioned electrodes 2*a*, 2*b*. The electrodes of each pair are connected to walls 16 and 18. The connector walls have insulation means 20 to attach the electrodes to the housing 1.

FIG. 2 shows that separation zones 12 and 14 are each being supplied with materials through space or zone inlet 4*a*, 4*b*, which are each in the form of a chute. The positions of separating panels 6*a*, 6*b* are adjusted by adjustment handles 5*a* and 5*b* as shown in FIG. 1 separately.

Figure 4:
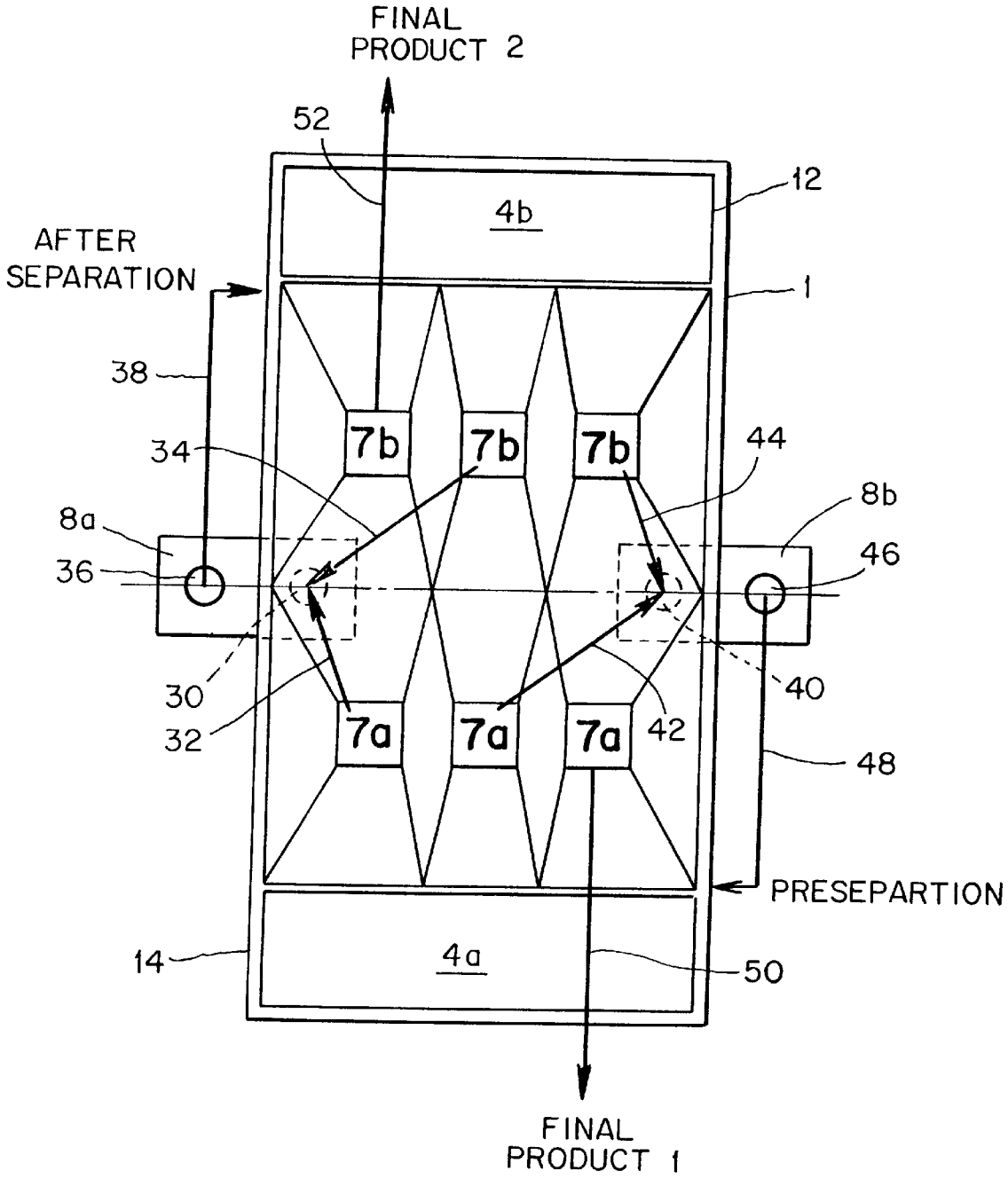
FIG. 4 shows a bottom view through the outlet zone of FIG. 1 illustrating a recycle circuit with pre-separation and after-separation, and recycling of the intermediate material, and with discharge of two final products.

The separation products comprise the positively charged product, the intermediate product and the negatively charged product. Each product drops into the material collection bin 22, 24 or 26. Each bin has an outlet 7*a*, 7*b*, respectively mounted below the drop line 7*c*. Outlets 7*a* are for the separation space 12 and outlets 7*b* are for separation space 14. Thus, there are at least six material outlets which are present with two of them for the final products. Certain product material outlets can be selectively connected with each one of the conveyor devices 8*a* and 8b, as shown in FIG. 4. The separated voltage sources 9*a* and 9*b* are usefully connected within a screened area of the electrode, as shown in FIG. 1.

FIG. 4 illustrates the following preferred embodiment. Certain product material outlets can be selectively connected with each one of the conveyor devices 8*a* and 8*b*. Conveyor 8*a* has an inlet 30 into which product from left side outlet 7*a* is conveyed along path 32 into inlet 30. Similarly, product from middle outlet 7*b* is conveyed along path 34 into inlet 30. Conveyor 8*a* has an outlet 36 from which the combined product of paths 32 and 34 is conveyed as a recycle stream along path 38 which is recycled to inlet 4*b* for reseparation in order to achieve an extremely high degree of purity in the final product 2. Conveyor 8*b* has an inlet 40 into which product from middle outlet 7*a* is conveyed along path 42 into inlet 40. Similarly product from right side outlet 7*b* is conveyed along path 44 into inlet 40. Conveyor 8*b* has an outlet 46 from which the combined product of paths 42 and 44 is conveyed as a recycle stream along path 48 which is recycled to inlet 4*a* for reseparation in order to achieve an extremely high degree of purity in the final product 1. The final product 1 is withdrawn along path 50 from the right side outlet 7*a*. The final product 2 is withdrawn from left side outlet 7*b* along path 52.

For different types of separation, the polarity of the electrodes as well as the connection of the material outlets (7*a*, 7*b*) with the separation space or zone inlets (4*a*, 4*b*) can be varied in any desired way. Thus, the advantages offered by the invention are realized and separation is accomplished in an economical way.

While several embodiments of the present invention have been shown and described, it is to be understood that many changes and modifications may be made thereunto without departing from the spirit and scope of the invention as defined in the appended claims.

What is claimed is:

1. Electrostatic separator having a center for separating a triboelectrically charged mixture of substances, comprising a pair of electrodes with each electrode having an opposite polarity vertically arranged in a housing, with a separating space being formed between said electrodes;

wherein the electrodes comprise two electrode pairs positioned closely adjacent to each other, and said two pairs of electrodes being separated from each other by a nonconductive wall in such a way that the electrodes having the same polarity are in each case aligned, thereby forming two separation zones;

each separation zone having an outlet for the intermediate material, an outlet for the positively charged material, and an outlet for the negatively charged material;

an inlet chute for the separating space through which the mixture to be separated is freely dropping into the separating space;

a separate voltage source being connected to each of said electrodes in such a way that one voltage source supplies a positive voltage against ground potential and another voltage source supplies a negative voltage against ground potential, causing a potential difference against ground to be equal to zero in the center of the separator, and said separating space containing said potential difference and causing separation products to be formed;

whereby at least two final product outlets are present and the remaining material outlets are selectively connected via conveyor system with said inlet chute of one of the two separating spaces.

2. Electrostatic separator according to claim 1, wherein one voltage source and the other voltage source which provide the potential difference against ground are equal to each other or are approximately equal to each other independently of the sign on said electrodes; and in each case the voltage approximately ranges from 20,000 volts to 80,000 volts, resulting in a total potential difference between the electrodes of 40,000 volts to 160,000 volts.

3. Electrostatic separator according to claim 1, wherein the conveyor system between the material outlet means and the separating space inlet chute is selected from the group consisting of an elevator, and a pneumatically operating conveyor.

4. Electrostatic separator according to claim 1, further comprising a charging means directly in front of the separating space inlet.

5. Electrostatic separator according to claim 1, wherein said two separation zones are adjacent to each other, and comprise a first separation zone and a second separation zone;

a first portion of the separation product from the first separation zone and a first portion of the separation product from the second separation zone are combined and are recycled to the first separation zone; and a second portion of the separation product from the first separation zone and a second portion of the separation product from the second separation zone are combined and are recycled to the second separation zone.

* * * * *